US006270164B1

(12) United States Patent
Seitle et al.

(10) Patent No.: US 6,270,164 B1
(45) Date of Patent: Aug. 7, 2001

(54) CUTTING TOOTH FOR EARTHWORKING

(75) Inventors: Ignaz Seitle, Karlshuld; Maximilian Arzberger, Hollenbach, both of (DE)

(73) Assignee: Bauer Spezialtiefbau GmbH, Schrobenhausen (DE)

( * ) Notice: Subject to any disclaimer, the term of this patent is extended or adjusted under 35 U.S.C. 154(b) by 0 days.

(21) Appl. No.: 09/190,002

(22) Filed: Nov. 12, 1998

(30) Foreign Application Priority Data

Nov. 14, 1997 (DE) ..... 297 20 261 U

(51) Int. Cl.[7] ..... E02F 9/28

(52) U.S. Cl. ..... 299/82.1; 299/108; 299/112; 37/465

(58) Field of Search ..... 299/79.1, 82.1, 299/108, 112; 37/465

(56) References Cited

U.S. PATENT DOCUMENTS 4,571,859 * 2/1986 Leischer ..... 37/465 X
4,998,574 * 3/1991 Beach et al. ..... 144/241

FOREIGN PATENT DOCUMENTS 87 15 141 11/1987 (DE) .

* cited by examiner

*Primary Examiner*—David Bagnell
*Assistant Examiner*—Sunil Singh
(74) *Attorney, Agent, or Firm*—Pepper Hamilton, LLP

(57) ABSTRACT

A cutting tooth is fitted in a cutting-tooth holder of an earthworking appliance which has at least one cutter. The cutter is mounted ahead of a cutter-support region, as seen in the cutting direction, and has at least one cutting edge. The size of the cross-sectional areas of the cutter-support region which lie perpendicular to the cutting advance direction and intersect the cutting edge remains approximately constant in the area which is delimited by in each case two such cross-sectional areas.

8 Claims, 4 Drawing Sheets

CUTTING TOOTH FOR EARTHWORKING

RELATED APPLICATIONS

This application claims priority from German Utility Model Application No. 297 20 261.8 filed Nov. 14, 1997, which is incorporated herein by reference.

FIELD OF THE INVENTION

The invention relates to a cutting tooth to be fitted in a cutting-tooth holder of an earthworking appliance.

Such an earthworking appliance may, for example, be a cutting wheel or a cutter chain which is used, in civil engineering, in diaphragm wall cutting appliances for producing diaphragm walls. The cutting teeth in each case comprise tooth root and cutter and are fitted on the earthworking appliance with the aid of cutting-tooth holders.

During operation, the cutting teeth are moved in the cutting direction, i.e. in the circumferential direction of the cutting wheel or in the running direction of the cutter chain. On the flank which faces in the respective direction of movement, the cutting teeth therefore have a cutter. On the one hand, the cutter penetrates into the earth lying in front of it in the particular cutting direction, and on the other hand the actual cutting advance is achieved by moving the cutting wheel or the cutter chain in the plane of rotation of the cutting wheel or of revolution of the cutter chain. The advance side, which faces in the direction of advance, of the cutting tooth is thus pressed against the earth in accordance with the cutting advance.

BACKGROUND OF THE INVENTION

DE-U 87 15 141 has disclosed a cutting tooth which, on the flank facing in the cutting direction, has a cutter which is mounted ahead of a cutter-support region, as seen in the cutting direction. The cutter axis is inclined slightly in the cutting direction. On the advance side, which faces in the direction of advance, the cutter-support region is flush with one end of the cutter, and in the area lying in the opposite direction to the cutting direction, is drawn down toward the tooth root by way of an arch which is slightly convex when seen from the side.

As a result of the cutting advance component of the movement of the cutting tooth, that edge of the cutter which faces in the cutting advance direction and the adjoining part of the cutter-support region are pressed against the earth and consequently are gradually ground down to assume a flatter shape. In the process, a surface which has been ground down essentially perpendicular to the cutting advance direction is produced in this part of the cutter-support region. Since the cutter-support region is drawn down toward the tooth root in the opposite direction to the cutting direction, this surface increases in size as the cutting tooth becomes increasingly worn. The result of this is that the cutting advance becomes ever more difficult as the wear to the cutting tooth increases, since an increasingly large "blunt" surface has to be pressed against the earth. In the cutting advance direction, only the outer edge of the cutter, as seen in the cutting direction, has a cutting function. The adjoining surface is pressed flat against the earth.

SUMMARY OF THE INVENTION

The invention is therefore based on the object of designing a cutting tooth which is to be fitted in a cutting-tooth holder of an earthworking appliance and has at least one cutter mounted ahead of a cutter-support region, as seen in the cutting direction, in such a manner that it allows an effective cutting advance combined with a simple design even with a ground-down advance side facing in the cutting advance direction.

This object is achieved for a cutting tooth of the generic type by the fact that the size of the cross-sectional areas of the cutter-support region which run perpendicular to the cutting advance direction and intersect the at least one cutting edge remains approximately constant in at least one area which is delimited by in each case two such cross-sectional areas.

As a result, while maintaining a simple design of the cutting tooth, the advance side, which is pressed against the earth, of the cutting tooth is not significantly increased in size when the cutting tooth has been ground down to such an extent that it has a cross-sectional area which remains approximately constant as the wear continues.

Consequently, a basic principle of the invention consists in providing the cutter-support region with a shape in which, in the individual cross-sectional planes parallel to the advance side, length and width are adapted to one another and depend on one another in such a way that the surfaces are identical in all the cross-sectional planes.

As a result of the cutting advance conditions being facilitated, the cutting tooth according to the invention leads to considerable savings on energy since the force which is to be applied in order to advance the cutter does not, as was previously the case, increase substantially as the level of wear increases. Furthermore, there is a considerable saving on materials, since the cutting tooth according to the invention only has to be replaced after a considerably greater level of wear has taken place. Furthermore, the cutting tooth according to the invention is extremely simple to produce.

According to an advantageous embodiment, the cutter-support region has, on the advance side, a step which is directed approximately parallel to the at least one cutting edge, the cutter-support region, which is oriented in the opposite direction to the cutting direction, being drawn down toward the tooth root. If, as a result of wear, the cutting tooth is ground down to as far as this step at its edge of the step which lies toward the cutting advance direction, the cross-sectional area running perpendicular to the cutting advance direction, on the advance side of the cutting tooth, is not increased in size during further use of the cutting tooth until the cutting tooth has been ground down over the entire height of the step. This step, which is extremely simple to produce, therefore results in extremely good conditions for the cutting advance.

According to a further advantageous embodiment, the cutter-support region has an elongate indent, which runs in the cutting direction, in the region of each of the side flanks. Therefore, a web which runs longitudinally in the cutting direction remains between these two indents. This measure too results in that surface area of the ground-down cutting tooth which is to be pressed against the earth increasing only slightly as the level of wear increases. When the surface of the cutting tooth reaches those ends of the indents which lie in the cutting direction, the cutting-tooth surface limit which lies in the opposite direction to the cutting direction merely moves along the steeply falling limit line of the indents which lies in the cutting direction and along the web. The width of the web is clearly considerably less than that of the overall cutting tooth, so that it contributes to the surface of the cutting tooth only to an insignificant extent. The advantageous embodiment presented here results in a very efficient level of support for the cutter-support region lying in the cutting direction and for the cutters despite the indents.

Good results are achieved if the indents continue to as far as that side of the cutting tooth which lies in the opposite direction to the cutting direction. As a result, its resistance as the cutting tooth moves in the cutting direction is kept very low.

An alternative advantageous embodiment consists in providing an indent in the cutter-support region over the entire width of the side facing in the cutting advance direction and in designing the side flanks in the form of a wedge, in such a manner that they are directed toward one another, in the form of a wedge, in the opposite direction to the cutting direction. As a result, in cases in which the support of the cutter-support region facing in the cutting direction and of the cutter in the cutting direction is not critical, it is possible to avoid an increase in the force required for the cutting advance movement in a particularly effective manner.

In this embodiment too, the indent is advantageously continued to as far as that side of the cutting tooth which lies in the opposite direction to the cutting direction, as a result of the kinetic resistance being reduced.

Furthermore, the support of the cutter-support region, facing in the cutting direction, and of the cutter is kept at a very good level, by means of that cutter-support region of the cutting tooth designed according to the invention which faces in the opposite direction to the cutting direction, if the concave transitions are considerably rounded. This is achieved, for example, by considerably rounding that edge of the step or of the indent which lies in the opposite direction to the cutting advance direction and in the cutting direction. This advantageous measure further reduces the risk of the cutter-support region which faces in the cutting direction breaking off.

BRIEF DESCRIPTION OF THE DRAWINGS

The invention is described below with reference to the figures, in which:

FIG. 7 shows a side view of a cutting tooth in accordance with the prior art, with the lines of wear drawn in.

DETAILED DESCRIPTION OF THE INVENTION

Figure 7:
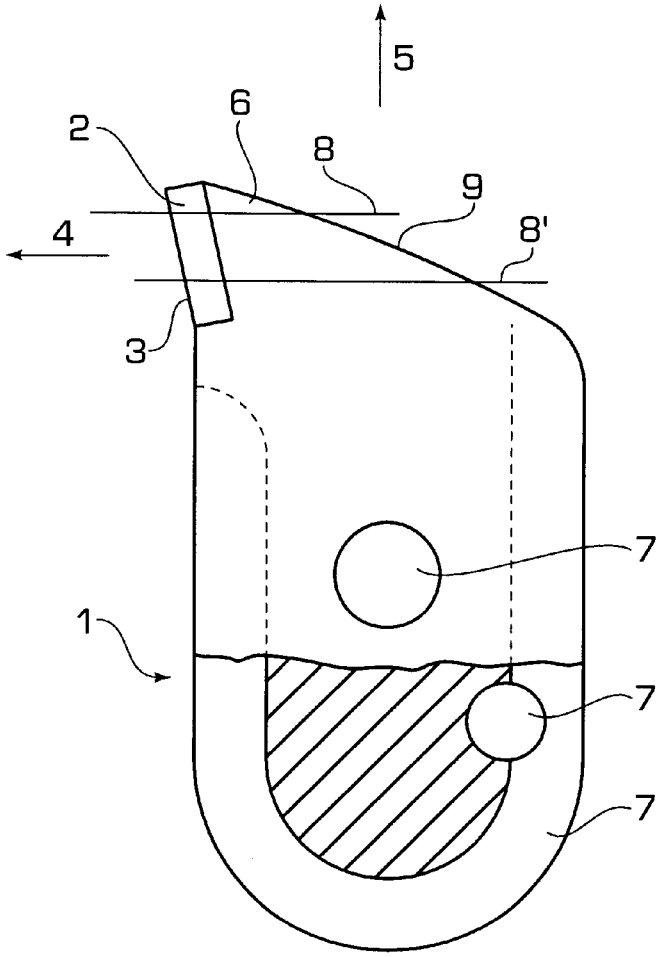
FIG. 7 PRIOR ART
Figure 8:
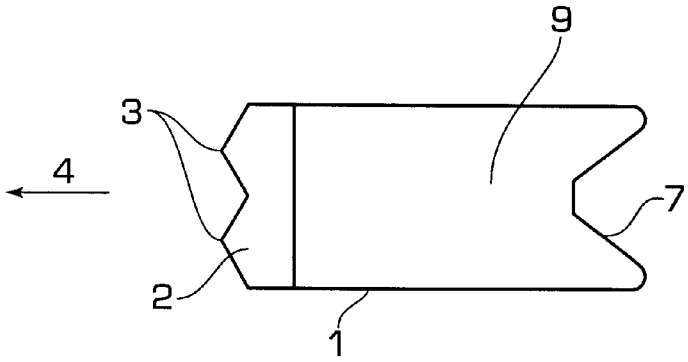
FIG. 8 PRIOR ART
FIG. 8 shows a view of the end side of the cutting tooth in accordance with FIG. 7.

FIGS. 7 and 8 show a cutting tooth in accordance with the prior art, comprising a tooth root 1 with suitable cutting-tooth holder elements 7 and with an attached cutter 2 having at least one cutting edge 3.

The movement components of the cutting tooth are defined by the movement of the cutting edge 3 during use on a cutting wheel or a cutter chain in an earthworking machine (not shown). The movement component, in which the cutter 2 penetrates into the earth lying in front of it, is referred to as the cutting direction 4. The cutting direction 4 may, for example, run tangentially with respect to the orbiting movement of the cutting wheel or to the running direction of a cutter chain. The movement component which lies in the plane of orbiting movement of the cutting wheel or of revolution of the cutter chain and runs perpendicular to the cutting direction 4 is referred to as the cutting advance direction 5.

A cutter-support region 6, the role of which is to absorb the forces acting on the cutter 2 during the cutting operation, is mounted behind the cutter 2, in the opposite direction to the cutting direction 4. In the case of the conventional cutting teeth, the width of the cutter-support region 6 is constant and the length increases from the outside inward, as can be seen from FIG. 8. That end side of the cutter-support region which lies in the cutting advance direction and is referred to below as the advance side has an active surface which when in advance operation sets resistance against cutting direction 4. This active surface corresponds to that surface area parallel to the advance side which ends flush with the outer free end of the cutter. During use, the active surface of the advance side 9 of the cutting teeth which are aligned in the cutting advance direction is pressed against the earth and, as a result of the simultaneous movement of these cutting teeth in the cutting direction 4, is gradually ground down as a result of wear.

In order to illustrate the level of wear in two different conditions, FIGS. 7 and 8 indicate two wear lines 8 and 8', the wear line 8 illustrating an initial, still low level of wear, and the line 8'illustrating an advanced and considerable level of wear. The drawing is to be understood as showing that the area of the cutting tooth which is situated outside one of the wear lines 8, 8' has in each case been ground down. It can clearly be seen that in the cutting tooth which is known from the prior art, the active surface of the cutter-support region 6 which has been ground down along the wear line increases as wear progresses, since the length of the active surface of the advance side 9 increases while the width remains constant. In the state which is illustrated by the wear line 8' which lies further toward the inside, for example, the ground-down active surface area extends over more than two thirds of the cutter-support region 6. This provides considerable difficulties for the cutting advance, since the abraded surface does not have any cutting function and is pressed against the earth in the cutting advance direction 5. Only the outer edge, lying in the cutting direction, of the cutter 2 has a cutting function.

Figure 1:
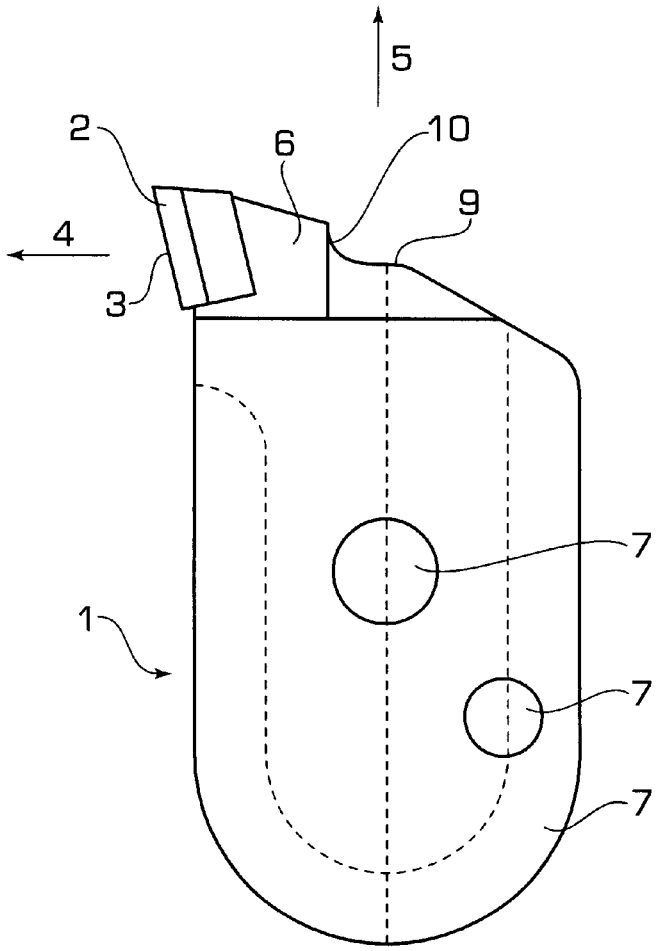
FIG. 1 shows a side view of a first cutting tooth according to the invention, having a step in the cutter-support region.
Figure 2:
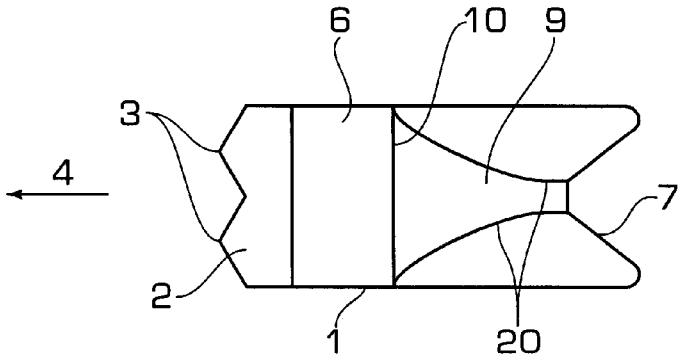
FIG. 2 shows a view of the end side of the cutting tooth in accordance with FIG. 1.

FIGS. 1 and 2 show a first cutting tooth according to the invention, having a step 10 running from the outside inward on the advance side 9 of the cutter-support region 6. The step 10 is in this case directed approximately parallel to the at least one cutting edge 3, that partial area of the cutter-support region 6 which adjoins it in the opposite direction to the cutting direction 4 being drawn down toward the tooth root in the opposite direction to the cutting direction. As a result of the parallel profile, the length of the active advance side 9 remains constant even as the level of wear increases. Therefore, the active advance surface area does not change even when the width remains constant. In an area next to the step, the constant cross-sectional area is achieved by the fact that as the active length of the active surface increases the width is reduced in accordance with a predetermined curve 20.

In operation, this surface area does not increase in size as a result of wear, since the step 10 or the reduction in width prevents the abraded surface from growing. The transition of the step 10 to the adjoining partial area of the advance side 9 is considerably rounded. As a result, shearing forces on that area of the cutter-support region 6 which faces toward the cutting direction, acting in the opposite direction to the cutting direction 4, are efficiently cushioned by this partial area of the advance side 9.

Figure 3:
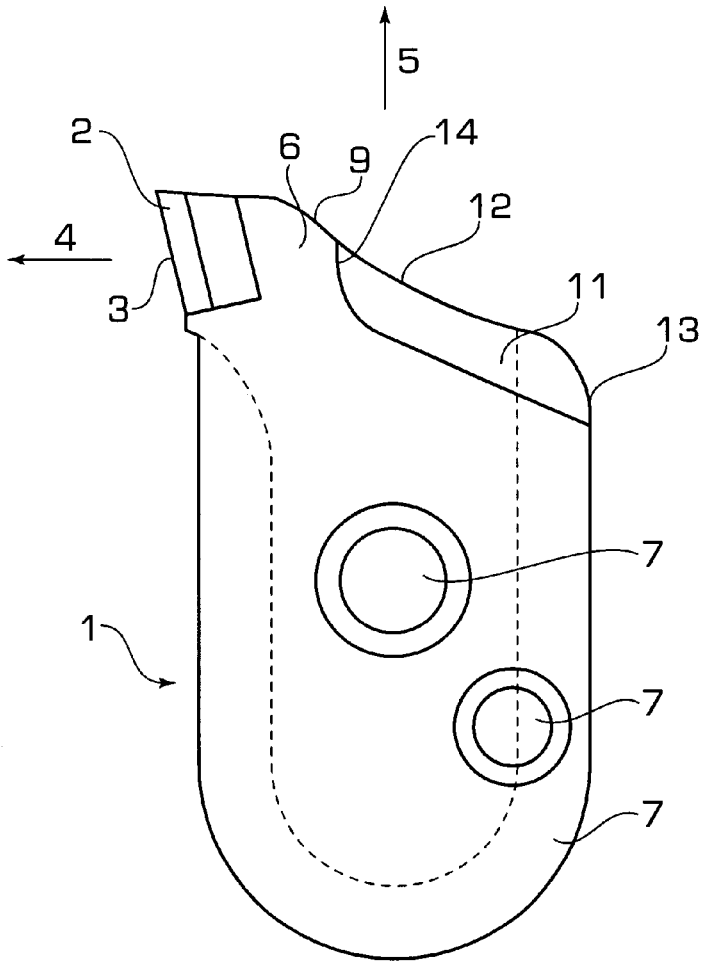
FIG. 3 shows a side view of a second cutting tooth according to the invention, having indents in the side flanks of the cutter-support region.
Figure 4:
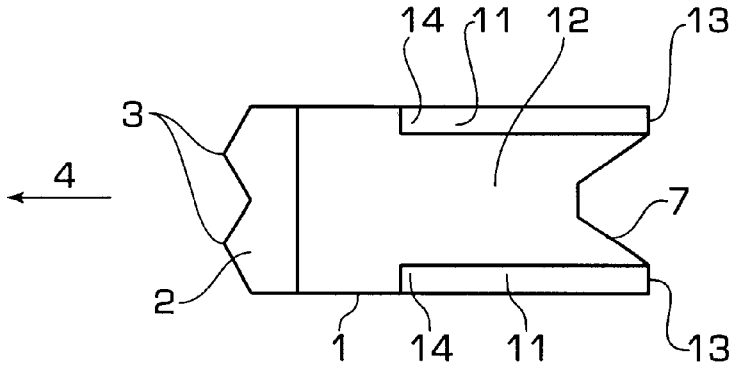
FIG. 4 shows a view of the end side of the cutting tooth in accordance with FIG. 3.

FIGS. 3 and 4 show a further advantageous embodiment of a second cutting tooth according to the invention, in which there are lateral indents 11 in an area of the advance side 9. A web 12 is situated between the indents 11. The indents 11 continue to as far as that edge 13 of the cutting tooth which lies in the opposite direction to the cutting direction 4. The flank 14 of the indent 11 is considerably rounded and leads vertically upward in its area which faces in the cutting advance direction 5. As a result, the abraded surface of the cutting tooth is essentially prevented from increasing in size as soon as the cutting tooth has been ground down to as far as that edge of the indent 11 which lies toward the cutting advance direction 5.

The steep flank 14 of the indent 11 means that the abraded surface only spreads to a slight extent in the opposite direction to the cutting direction 4. The abraded surface grows in the opposite direction to the cutting direction 4 only on the remaining narrower surface of the web 12. The web 12 efficiently cushions shearing forces exerted on that area of the cutting tooth which faces toward the cutting direction 4.

Figure 5:
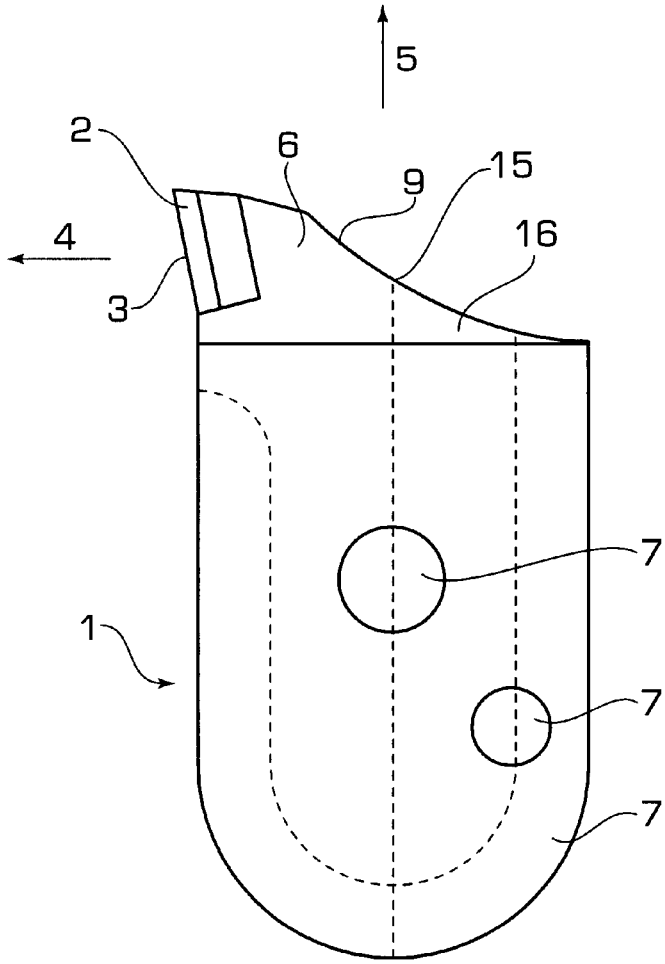
FIG. 5 shows a side view of a third cutting tooth according to the invention, with an indent, which runs over the entire width of the cutting tooth, in the cutter-support region.
Figure 6:
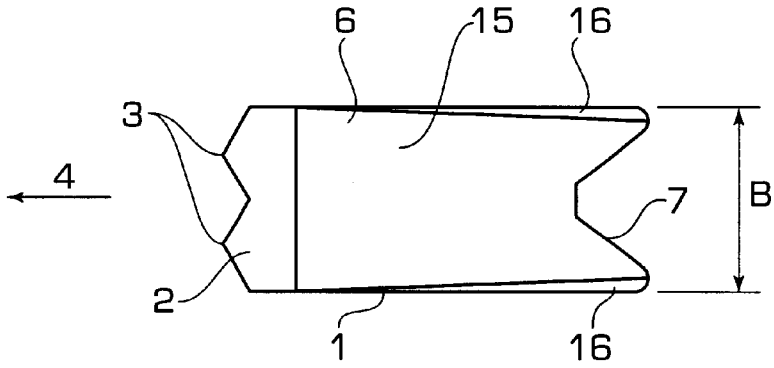
FIG. 6 shows a view of the end side of the cutting tooth in accordance with FIG. 5.

Finally, FIGS. 5 and 6 show a cutting tooth according to the invention which has an indent 15 which extends over the entire width B of the cutting tooth in the cutter-support region 6. In this embodiment too, the cutting advance is facilitated in that the steeply descending indent 15, in combination with a wedge-like design of the side flanks 16 in the cutter-support region 6 of the cutting tooth, prevents the ground-down surface area from increasing in size in the cutter-support region 6.

What is claimed is:

1. A cutting tooth to be fitted in a cutting-tooth holder of an earthworking appliance, said cutting tooth having at least one cutter, which is mounted ahead of a cutter-support region, as seen in a cutting direction, and having at least one cutting edge, wherein said cutter-support region has an elongate indent, running in the cutting direction, in each side flank, and wherein a size of each cross-sectional area of said cutter-support region that lies perpendicular to a cutting advance direction and intersects said at least one cutting edge, remains approximately constant in at least one area, which is delimited by, in each case, two such cross-sectional areas.

2. The cutting tooth as claimed in claim 1, wherein the cutter-support region has, on its advance side facing in the cutting advance direction, a step that is directed approximately parallel to said at least one cutting edge, wherein that partial area of the cutter-support region adjoins said step in an opposite direction to the cutting direction and is drawn down toward a tooth root in the opposite direction to the cutting direction.

3. The cutting tooth as claimed in claim 2, wherein the step is rounded at a concave transition toward the adjoining partial area of the advance side.

4. The cutting tooth as claimed in claim 1, wherein side flanks of the cutter-support region are designed in the form of a wedge, in such a manner that they are directed toward one another, in at least one of the cutting advance direction and in the opposite direction to the cutting direction.

5. The cutting tooth as claimed in claim 1, wherein the indents continue to as far as that side of the cutting tooth which lies in the opposite direction to the cutting direction.

6. The cutting tooth as claimed in claim 1, wherein an advance side, which faces in the cutting advance direction of the cutter-support region, has an indent over an entire width of the cutting tooth, and each said side flank in the cutter-support region is designed in the form of a wedge, in such a manner that each said side flank is directed toward one another in the opposite direction to at least one of the cutting direction and in the cutting advance direction.

7. The cutting tooth as claimed in claim 6, wherein the indent continues to as far as that side of the cutting tooth which lies in the opposite direction to the cutting direction.

8. A cutting tooth to be fitted in a cutting-tooth holder of an earthworking appliance, said cutting tooth having at least one cutter, which is mounted ahead of a cutter-support region, as seen in a cutting direction, and having at least one cutting edge, wherein a size of each cross-sectional area of said cutter-support region that lies perpendicular to a cutting advance direction and intersects said at least one cutting edge, remains approximately constant in at least one area, which is delimited by, in each case, two such cross-sectional areas, wherein an advance side, which faces in the cutting advance direction, of the cutter-support region has an indent over an entire width of the cutting tooth, and each side flank in the cutter-support region is designed in the form of a wedge, in such a manner that each flank is directed toward one another in the opposite direction to at least one of the cutting direction and in the cutting advance direction.

* * * * *